United States Patent [19]

Price

[11] 4,148,116

[45] Apr. 10, 1979

[54] YARN TEXTURING AIR JET BAFFLE

[75] Inventor: Samuel T. Price, Kennett Square, Pa.

[73] Assignee: Enterprise Machine and Development Corporation, New Castle, Del.

[21] Appl. No.: 875,396

[22] Filed: Feb. 6, 1978

[51] Int. Cl.[2] ..... D02G 1/16

[52] U.S. Cl. ..... 28/254; 28/273

[58] Field of Search ..... 28/254, 258, 271, 273; 57/77.3, 157 F; 226/7, 97

[56] References Cited

U.S. PATENT DOCUMENTS

| | | | |
|---|---|---|---|
| 3,724,038 | 4/1973 | Chimura et al. | 28/273 |
| 3,881,231 | 5/1975 | Price et al. | 28/273 X |
| 3,881,232 | 5/1975 | Price et al. | 28/254 |
| 4,041,583 | 8/1977 | Hart et al. | 28/273 X |

FOREIGN PATENT DOCUMENTS

| | | | |
|---|---|---|---|
| 695165 | 9/1964 | Canada | 28/254 |

*Primary Examiner*—Louis Rimrodt

*Attorney, Agent, or Firm*—Bell, Seltzer, Park & Gibson

[57] ABSTRACT

The baffle is in the form of a relatively thin flat plate supported in a fixed position substantially perpendicular to and spaced from the exit orifice of the air jet. The baffle is provided with an opening through which the yarn passes after leaving the exit orifice of the air jet. The opening produces a shock wave in the air leaving the exit orifice and passing through the opening and the yarn is drawn against an edge of the opening which functions as a twist trap. First adjustment means is provided for varying the distance between the baffle and the exit orifice and second adjustment means is provided for varying the perpendicular position of the baffle relative to the exit orifice. This baffle permits higher operating speed of the air jet and enhances the crimps, curls and loops imparted to the yarn by the air jet.

13 Claims, 4 Drawing Figures

YARN TEXTURING AIR JET BAFFLE

This invention relates generally to a yarn texturing air jet and more particularly to a relatively thin flat baffle positioned adjacent the exit orifice of the air jet with an opening being provided in the baffle through which the yarn passes and the yarn engages one edge of the opening as it passes through the baffle.

It is generally known to utilize various types of cylindrical and flat baffles adjacent the exit end of a yarn texturing air jet. These baffles have been engaged by and deflect the yarn as well as the air leaving the exit orifice of the air jet. While these various types of baffles have been effective to increase the efficiency of the air jet, as far as it is known, these prior types of baffles have not been provided with an opening through which the yarn passes.

With the foregoing in mind, it is an object of the present invention to provide a yarn texturing air jet baffle which is provided with an opening through which the yarn passes after it leaves the exit orifice of the air jet and through which a portion of the air leaving the air jet also passes to produce a shock wave which permits higher operating speed and further enhances the crimps, curls and loops produced in the filaments of the yarn.

In accordance with the present invention, the baffle is supported in a position substantially perpendicular to and spaced from the exit orifice of the air jet. First adjustment means is provided for varying the distance between the baffle and the exit orifice and second adjustment means is provided for varying the perpendicular position of the baffle relative to the exit orifice. As the air leaves the exit orifice of the air jet, the yarn passes over an edge of the opening formed in the baffle to provide a twist trap which acts to accelerate the formation of curls and loops in the yarn filaments and a shock wave is produced on the outboard side of the opening in the baffle through which the yarn travels. The passage of the yarn through the varying pressure gradients of the shock wave appears to further enhance the crimps, curls and loops initially produced in the turbulent chamber of the jet.

Other objects and advantages will appear as the description proceeds when taken in connection with the accompanying drawings, in which FIG. 1 is an isometric view looking downwardly on an air texturing jet and illustrating the baffle of the present invention associated therewith;

Figure 4:
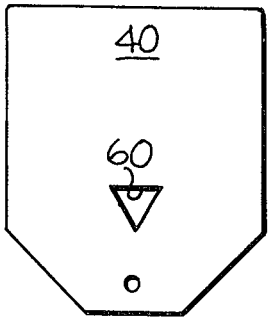
FIG. 4 is a front elevational view of the baffle plate, removed from the support block.

The baffle of the present invention is illustrated and described in association with a particular type of yarn texturing air jet, however, it is to be understood that the present baffle may be utilized in connection with other types of yarn texturing air jets. The air jet includes an elongate housing 10 having a central bore 11 (FIG. 2) extending therethrough. Venturi means is suitably supported in the exit end of the housing 10 and in the central bore 11 and includes a venturi 12 having an inwardly tapered conical inner wall 13 defining the exit end of a turbulence chamber. A yarn guiding needle 14 is positioned in the entrance end of the housing 10 and the outermost main body portion of the needle 14 is of the same diameter as the central bore 11.

The inner end or end face of the needle 14 is tapered inwardly and extends generally at right angles to the longitudinal axis of the needle to define the entrance end of the turbulence chamber. The inner end of the yarn guiding needle 14 extends at least partially into and is centered within the inwardly tapered conical inner end wall 13 of the venturi 12 to define a restricted airflow passageway completely surrounding the inner end of the needle. The volume of air is increased in an arcuate segment of the restricted airflow passageway so that a greater volume of air enters the turbulence chamber at one side of the inner end of the needle. This is accomplished by a cut-away portion illustrated as a beveled face 16 provided on one side of the inner end of the needle 14.

Figure 2:
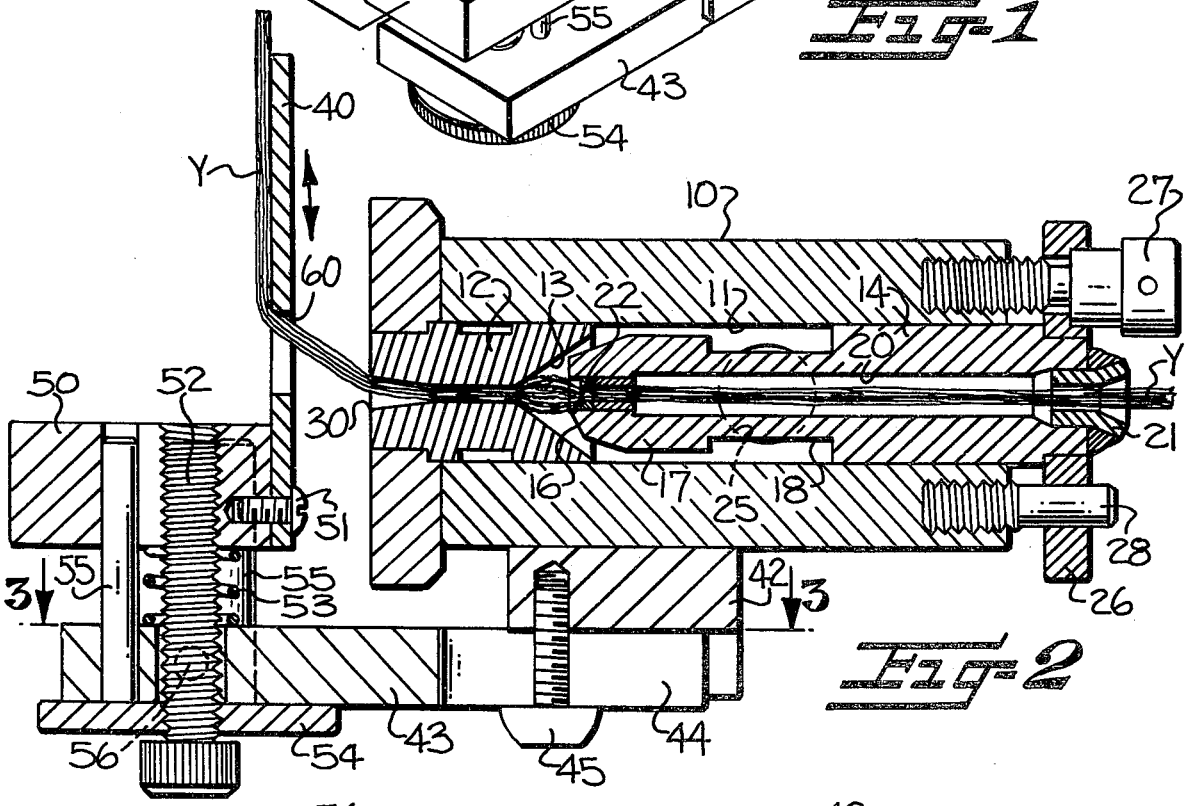
FIG. 2 is an enlarge longitudinal vertical sectional view taken substantially along the line 2—2 in FIG. 1.

The inner end portion of the needle 14 is provided with a relatively large cylindrical portion 17 and a reduced cylindrical portion 18 between the cylindrical portion 17 and the outermost main body of the needle 14. A yarn passageway 20 extends along the longitudinal axis and through the needle 14 and provides an exit opening in the inner end of the needle. A ceramic yarn guide 21 may be provided in the entrance end of the yarn passageway 20 and a sapphire guide 22 may be provided in the exit end of the yarn passageway 20 of the needle 14 (FIG. 2).

Figure 1:
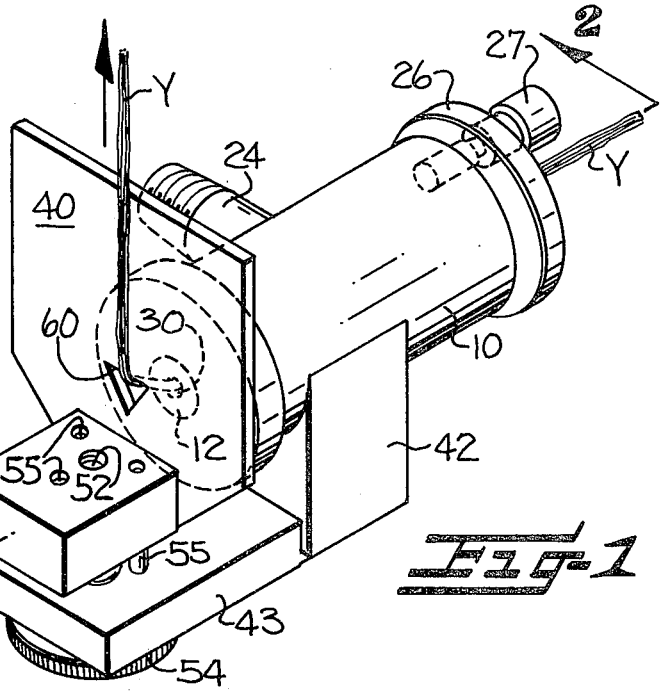

Means is provided for directing pressurized air into the central bore 11 so that the air completely surrounds and passes along the cylindrical portions 17 and 18 of the needle and enters the turbulence chamber through the restricted airflow passageway around the inner end of the needle. To this end, a fluid inlet nipple 24 is fixed at its inner end in one side of the housing 10 (FIG. 1) and the outer end of the nipple 24 is adapted to be connected to any suitable source of pressurized gas or air, not shown. The pressurized air passes through nipple 24 and enters the central bore 11 through an air inlet 25 (FIG. 2).

The yarn guiding needle 14 may be supported for longitudinal adjustment in the central bore 11 in any one of a number of ways and is illustrated as being fixed at its outer end to an adjustment cap 26. Adjustment is provided by a shoulder screw 27 which is threadably supported at its inner end in the housing 10 and passes through an opening in the adjustment cap 26. A guide pin 28 is threadably supported at its inner end in the housing 10 and its outer end slideably penetrates the adjustment cap 26. The shoulder screw 27 may be rotated so that the inner end of the needle 14 is adjusted inwardly or outwardly and the air pressure entering the inlet 25 normally maintains the needle 14 in the outermost position with the cap 26 against the enlarged shoulder of the screw 27.

The yarn Y enters the air jet through an entrance end, defined by the ceramic yarn guide 21, and passes through the yarn passageway 20 in the needle 14. Crimps, curls and loops are imparted to the yarn Y as it passes through the turbulence chamber, defined by the inner end of the needle 14 and the inwardly tapered conical inner wall 13 of the venturi 12. The yarn Y then passes through the venturi and out of the jet through an exit orifice 30.

In accordance with the present invention, a relatively thin flat baffle 40 is positioned adjacent the exit orifice 30 of the air jet and is maintained in the desired adjusted position by support means carried by the air jet. The support means maintains the baffle in a position substantially perpendicular to and spaced from the exit orifice. The support means for the baffle includes first adjustment means for varying the distance between the baffle and the exit orifice and second adjustment means for varying the perpendicular position of the baffle relative to the exit orifice.

To this end, a mounting block 42 is fixed to the housing 10 of the air jet and one end of a support bar 43 is supported for longitudinal adjustment on the mounting block 42 with the opposite end of the support bar 42 extending outwardly beyond the exit orifice 30 of the air jet. Longitudinal adjustment of the support bar is provided by means of an elongate slot 44 in the inner end of the support bar 43 and a screw 45 extending through the slot 44 and being threadably supported in the mounting block 42.

The baffle 40 is operatively supported adjacent the outer end of the support bar 43 and may be adjusted vertically by the second adjustment means to vary the perpendicular position of the baffle 40 relative to the exit orifice 30 of the air jet. The second adjustment means includes a support block 50 to which the lower portion of the baffle 40 is fixed, as by a screw 51 (FIG. 2). Threaded adjustment means operatively connects the outer end of the support bar 43 and the support block 50 for varying the distance between the support block 50 and the support bar 43 and to thereby vary the perpendicular position of the baffle 40 relative to the exit orifice 30 of the air jet.

Figure 3:
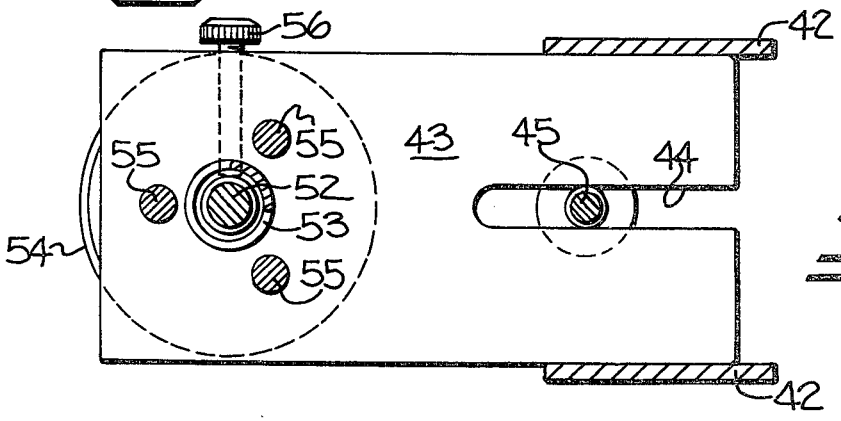
FIG. 3 is a sectional plan view taken substantially along the line 3—3 in FIG. 2.

To this end, the upper end of a screw 52 is threadably supported in the support block 50 (FIG. 2) and slideably penetrates an opening in the outer end of the support bar 43. A compression spring 53 surrounds the medial portion of the screw 52 and urges the support block 50 to an uppermost position. An adjustment wheel 54 is threadably supported on the screw 52 and bears against the lower surface of the support bar 43 to provide adjustment means for raising and lowering the support block 50 and the baffle 40 carried thereby. Guide pins 55 are fixed at their lower ends in the outer end of the support bar 43 and their upper ends slideably penetrate the support block 50 to maintain the baffle 40 in perpendicular relationship to the exit orifice 30 of the air jet. A lock screw 56 (FIG. 3) is provided to lock the screw 52 in adjusted position so that the baffle 40 is maintained in the adjusted position when the air jet is operated.

The baffle 40 is provided with an edge 60 against and over which the yarn Y is relatively thin and drawn after leaving the exit orifice 30. The edge 60 is relatively thin and defined by the upper edge of an opening 61 in the thin baffle 40 through which the yarn passes after leaving the exit orifice 30. The opening 61 is illustrated as an equilateral triangle with the yarn being drawn against the medial portion of the edge 60 defined by the upper horizontal leg of the equilateral triangle opening after it leaves the exit orifice 30. The size and shape of the opening 61, as well as the type of edge over which the yarn is drawn as it leaves or passes through the baffle 40 may be varied depending upon the size and type of yarn being textured. Also, as best seen in FIG. 2, a portion of the opening 61 in the baffle is aligned with a portion of the exit orifice 30, and a portion of the baffle is aligned with and perpendicularly faces the remainder of the exit orifice. Thus, a portion of the air leaving the exit orifice 30 passes through the opening 61 in the baffle 40 while the remainder of the air strikes the inner face of the baffle.

It has been found that a range of yarn sizes and types can be satisfactorily textured with a substantially rectangular baffle of the type illustrated in FIG. 4. The baffle is $1\frac{3}{4}$ inches wide, 2 inches high and the lower corners are preferably removed. The opening in the baffle is in the shape of an equilateral triangle with the base horizontal leg being uppermost and with each leg of the triangle being 5/16 of an inch in length. The baffle thickness is 0.061 of an inch and the distance between the exit orifice 30 and the inner surface of the baffle 40 is 5/16 of an inch. The upper edge 60 of the equilateral triangle opening 61 is positioned out of axial alignment with the exit orifice 30 and approximately $\frac{1}{4}$ inch above the top of the exit orifice 30 so that the yarn Y travels in a slightly upward path as it leaves the exit orifice 30 and moves into engagement with the edge 60 as it passes through the opening in the baffle 40. The yarn Y then moves up the planar face of the baffle 40 on the side remote from the exit orifice 30 and is wound up on a suitable take-up package, not shown.

As a specific but nonlimiting example, it has been found that a 150 denier 68 filament polyester yarn can be texturized with the illustrated air jet and baffle 40 at a rate of in excess of 800 meters per minute and this represents an increase in speed of from 50 to 75 percent over the rate at which the same type of yarn can be textured without the baffle of the present invention. In this example, the air to the jet is under pressure of 120 pounds per square inch and the tension on the yarn at wind up is about 40 to 45 grams.

It is not completely understood how the opening in the baffle operates to provide the enhanced texturing and to permit the increased operating speed, however, it is believed that the air being exhausted from the air jet through the exit orifice 30 creates a shock wave on the downstream side of the baffle as at least a portion of the air passes through the opening 61. The yarn passing through the different pressure gradients of the shock wave is again exposed to an additional turbulence after the initial crimps, loops and coils are formed in the turbulence chamber in the air jet. The edge 60 also is believed to contribute to the increased speed of operation and the improved yarn. The edge 60 appears to act as a twist trap which facilitates the formation of kinks and whorls in the yarn filaments.

In the drawings and specification, there has been set forth a preferred embodiment of the invention, and although specific terms are employed, they are used in a generic and descriptive sense only and not for purposes of limitation, the scope of the invention being defined in the claims.

That which is claimed is:

1. In a yarn texturing air jet of the type including an elongate housing having a central bore therethrough, an entrance end for passage of yarn into said air jet, an exit orifice for passage of yarn and air from said air jet, and means for directing pressurized air into the central bore of said housing to contact the yarn and pass outwardly through the exit end of said air jet to impart crimps, curls and loops to the filaments as the yarn passes through said air jet, the combination therewith of a baffle positioned adjacent said exit orifice of said air jet, means for supporting said baffle in a position substantially perpendicular to and spaced from said exit orifice, said baffle including a relatively thin edge out of axial alignment with said exit orifice and against which the yarn is drawn after leaving said exit orifice of said air jet, and said baffle also including a flat outer face on the side remote from said exit orifice with the yarn traveling along said outer face after engaging said edge.

2. A yarn texturing air jet according to claim 1 wherein said baffle is provided with an opening through which the yarn passes after leaving said exit orifice, wherein said edge against which the yarn is drawn comprises a portion of said opening, and wherein a portion of said opening is aligned with a portion of said exit orifice so that a portion of the air leaving said exit orifice passes through said opening while the remainder strikes said baffle.

3. A yarn texturing air jet according to claim 2 wherein said opening in said baffle comprises an equilateral triangle, and wherein the yarn is drawn against the medial portion of one leg of said equilateral triangle opening after leaving said exit orifice.

4. A yarn texturing air jet according to claim 3 wherein each side of said equilateral triangle opening is about 5/16 of an inch in length.

5. A yarn texturing air jet according to claim 1 wherein said means for supporting said baffle includes first adjustment means for varying the distance between said baffle and said exit orifice of said air jet.

6. A yarn texturing jet according to claim 5 wherein said first adjustment means comprises a block fixed on said elongate housing, and a support bar supported for longitudinal adjustment adjacent one end on said block and having an opposite end extending outwardly beyond said exit orifice of said air jet, said baffle being operatively supported adjacent said opposite end of said support bar.

7. A yarn texturing air jet according to claim 1 wherein said means for supporting said baffle includes second adjustment means for varying the perpendicular position of said baffle relative to said exit orifice of said air jet.

8. A yarn texturing air jet according to claim 7 including a block fixed on said elongate housing, and a support bar supported for longitudinal adjustment adjacent one end on said block and having an opposite end extending outwardly beyond said exit orifice of said air jet, and wherein said second adjustment means comprises a support block fixed to said baffle and spaced from said opposite end of said support bar, and threaded adjustment means operatively connecting said support block and said support bar for varying the distance between said support block and said support bar and to thereby vary the perpendicular position of said baffle relative to said exit orifice of said air jet.

9. A yarn texturing air jet according to claim 8 including guide pin means operatively associated with said support bar and said support block for guiding said baffle during adjustment by said threaded adjustment means.

10. In a yarn texturing air jet of the type including an elongate housing having a central bore therethrough, an entrance end for passage of yarn into said air jet, an exit orifice for passage of yarn from said air jet, and means for directing pressurized air into the central bore of said housing to contact the yarn and pass outwardly through the exit end of said air jet to impart crimps, curls and loops to the filaments as the yarn passes through said air jet, the combination therewith of a relatively thin flat baffle positioned adjacent said exit orifice of said air jet, means for supporting said baffle in a position substantially perpendicular to and spaced from said exit orifice, said baffle including an opening through which the yarn passes after leaving said exit orifice, said opening including an edge against which the yarn is drawn after leaving said exit orifice of said air jet, said baffle also including a planar face on the side remote from said exit orifice with the yarn traveling along said planar face after passing through said opening and engaging said edge, said means for supporting said baffle including first adjustment means for varying the distance between said baffle and said exit orifice, and said means for supporting said baffle also including second adjustment means for varying the perpendicular position of said baffle relative to said exit orifice.

11. A yarn texturing air jet according to claim 10 wherein said opening in said baffle comprises an equilateral triangle and wherein the yarn is drawn against the medial portion of one leg of said equilateral triangle opening after leaving said exit orifice.

12. A yarn texturing air jet according to claim 11 wherein each side of said equilateral triangle opening is about 5/16 of an inch in length.

13. A yarn texturing jet according to claim 10 wherein said edge of said opening is positioned out of alignment with said exit orifice so that the yarn travels an angular path from said exit orifice to said edge.

* * * * *

UNITED STATES PATENT OFFICE

CERTIFICATE OF CORRECTION

PATENT NO. : 4,148,116

DATED : April 10, 1979

INVENTOR(S) : Samuel T. Price

It is certified that error appears in the above-identified patent and that said Letters Patent are hereby corrected as shown below:

Column 1, line 51, "enlarge" should be -- enlarged --;

Column 3, line 49, delete "relatively thin and";

Column 4, line 5, following "opening" insert -- 61 --;
line 6, following "baffle" insert -- 40 --.

Signed and Sealed this

*Thirty-first* Day of *July 1979*

[SEAL]

*Attest:*

*Attesting Officer*

LUTRELLE F. PARKER

*Acting Commissioner of Patents and Trademarks*